United States Patent [19]

Clark, Jr. et al.

[11] 4,342,130

[45] Aug. 3, 1982

[54] TRAVELLING SUCTION CLEANING APPARATUS

[75] Inventors: Amos S. Clark, Jr., Lewisville; James R. McMordie; Michael D. Walker, both of Winston-Salem, all of N.C.

[73] Assignee: The Bahnson Company, Winston-Salem, N.C.

[21] Appl. No.: 228,825

[22] Filed: Jan. 27, 1981

[51] Int. Cl.[3] ..... A47L 9/20

[52] U.S. Cl. ..... 15/312 A

[58] Field of Search ..... 15/312 R, 312 A

[56] References Cited

U.S. PATENT DOCUMENTS

| | | | |
|---|---|---|---|
| 3,245,103 | 4/1966 | King | 15/312 A |
| 4,042,998 | 8/1977 | Blough et al. | 15/312 A |
| 4,198,726 | 4/1980 | Powell | 15/312 A |

*Primary Examiner*—Chris K. Moore

*Attorney, Agent, or Firm*—Dann, Dorfman, Herrell & Skillman

[57] ABSTRACT

An improved cleaning apparatus for textile machines, of the type that includes overhead trackways and cleaner units propelled along the trackways, is provided with an arrangement for automatically removing accumulated lint from the cleaner units while cleaner units are moving along the trackways. During cleaning of the textile machines, lint is stripped from lint-laden intake air by conical screens respectively associated with the depending suction tubes of the cleaner unit. Hinged doors are arranged above and below each conical lint-stripping screen, and all four of these doors are opened at a lint collection station so that the accumulated lint may be rapidly withdrawn from the smaller ends of the screens directly into suction hoods. Mechanical door-actuating mechanisms are provided so that the cleaner unit is automatically doffed when moving in one direction through the lint removal station and so that the cleaner unit can, dependent on the desired trackway configuration, be driven in the opposite direction through the lint removal station without necessarily opening the doors.

15 Claims, 8 Drawing Figures

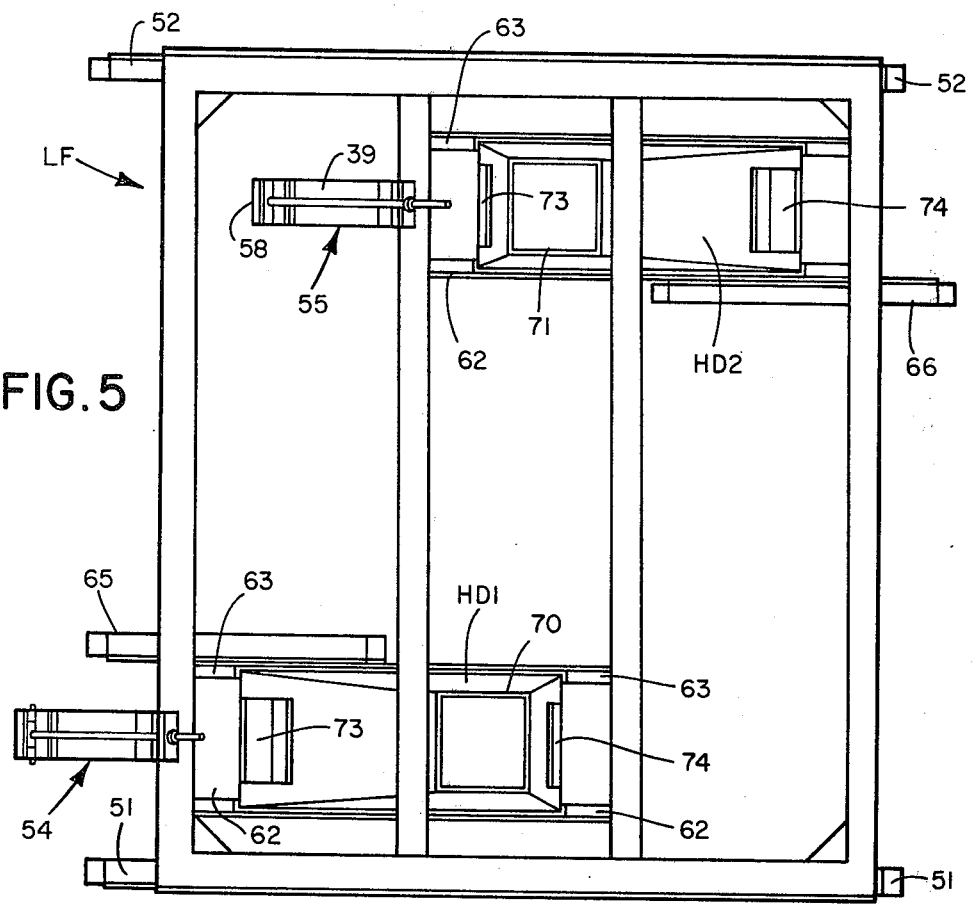
FIG. 5
FIG. 6
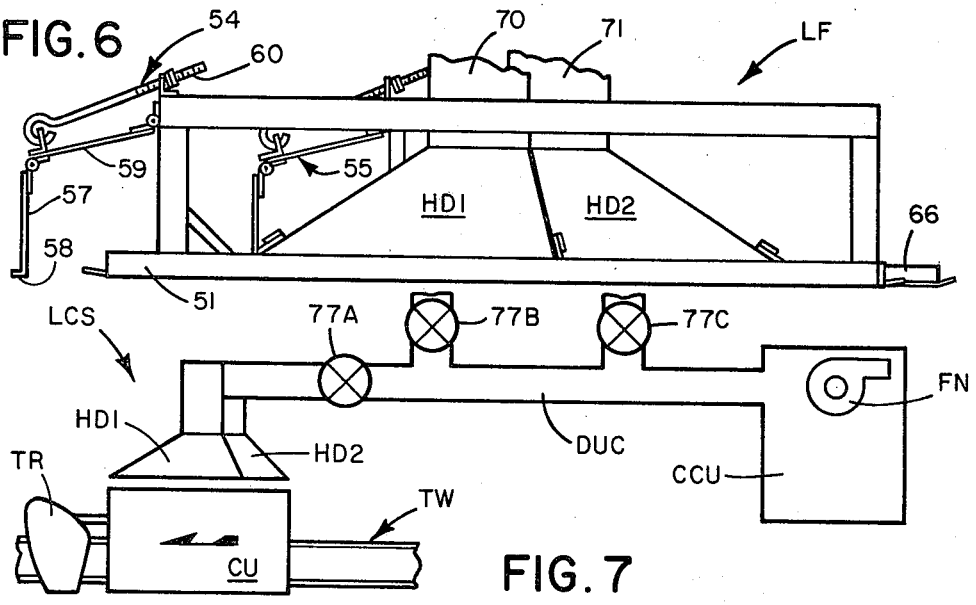
FIG. 7

TRAVELLING SUCTION CLEANING APPARATUS

BACKGROUND OF THE INVENTION

The present invention generally relates to travelling suction cleaning apparatus for removing lint, dust and other light material from room and machine surfaces in textile mills. More particularly, the present invention pertains to travelling suction cleaning apparatus having mobile lint collection chambers and means for automatically removing the accumulated lint from the collection chambers.

One example of a prior art travelling suction cleaning apparatus is shown and described in U.S. Pat. No. 3,011,202 issued Dec. 5, 1961 to G. B. Holtzclaw. Several travelling suction cleaners are supported on several transversely spaced, endless trackways. The trackways are supported above respective rows of spinning machines in a room of a textile mill. The Holtzclaw patent discloses a travelling cleaner unit having a lint collection box having a hinged discharge door that faces laterally of the direction of travel of the cleaner. Waste removal chambers are located adjacent the ends of the trackways on which the cleaners move, and the waste removal chambers are all connected to a common ductway that leads to a suction collecting unit. As a travelling cleaner is driven around the end of its trackway, the discharge door of the collection box thereof is momentarily aligned with the mouth of the removed chamber; and the hinged door is then opened for a short time so that the accumulated lint may be blown from the collection box into the waste removal chamber.

Another example of a textile machine cleaning apparatus that is provided with means for automatically removing the lint from a travelling cleaner is described in U.S. Pat. No. 3,372,425 granted Mar. 12, 1968 to R. L. Black, Jr. The Black patent discloses a travelling suction cleaner that includes two substantially cylindrical collection chambers located on the same side of the support trackway. Each chamber has a exhaust filter therein for stripping lint from intake air. Conduit means are provided for interconnecting the lint collection chambers with a vertical lint discharge passageway. As the travelling cleaner is brought to a stop at a lint removal station, a discharge tube is lowered into abutment with the discharge passageway. Partial vacuum is then applied to remove the lint from the collection chambers through the discharge tube into a lint withdrawal duct that leads to a central collecting unit.

Yet another example of a suction cleaning apparatus for textile mills is shown in U.S. Pat. No. 3,299,463 granted Jan. 24, 1967 to L. R. McEachern. The McEachern patent discloses a pneumatic collection system including collection hoods that are mounted adjacent crane trackways above the paths of travel of air inlet and suction chambers. The hoods are disposed to be closely adjacent the filter screens when the cleaner units are moved below the hoods. A single main collection station is provided and includes a suction fan connected to all of the hoods by a conduit structure. The collection station also includes apparatus for removing lint from the air flowing from the several hoods.

As indicated hereinafter, the cleaning apparatus of the present invention is similar to and constitutes an improvement over the cleaning apparatus described in U.S. Pat. No. 3,245,103 granted Apr. 12, 1966 to J. F. King, Jr. The King Patent is owned by the assignee of the present invention. The cleaning apparatus of the present invention is also similar to and an improvement over the "Bahnson Combo-Jet Travelling Cleaner" that is manufactured and sold by the assignee of the present application; such cleaner is disclosed in the Envirotech Catalog 40-A, which Catalog is entitled, "Bahnson Combo-Jet Travelling Cleaner" and is marked with the date of March, 1978. The travelling cleaner shown in these two references includes a pair of transversly spaced collection chambers confined partially within cylindrical canisters located on opposite sides of the trackway. Lint is sucked into the collection chambers through suction trunks that respectively depend from the canisters. To remove the lint from the collection chambers, the canisters are provided with access doors at the bottoms of the canisters. In operation, when the lint is to be removed, the travelling cleaner is brought to a stop and the accumulated mass of lint is removed manually by opening the access doors and pulling the lint into an underlying receptacle.

SUMMARY OF THE INVENTION

According to the present invention, a travelling suction apparatus for cleaning textile rooms is provided with an automatic lint removal arrangement adapted to rapidly remove a substantial portion of the accumulated lint from the collection chambers of a travelling cleaner while the cleaner is moving on the associated trackway. Generally, each travelling cleaner includes at least one lint collection chamber, an annular lint screen or filter within the lint collection chamber that is open at both ends and a lint removal opening formed in the chamber walls near one open end of the screen. A lint removal hood is provided at a lint removal station located along the length of the trackway, and the hood is connected to a central lint collecting unit. As the travelling cleaner arrives at the lint removal station, the discharge opening is opened and exposed to the lint removal hood so that a substantial portion of the lint may be withdrawn from within the screen and into the hood.

BRIEF DESCRIPTION OF THE DRAWINGS

FIG. 5 is a reduced scale top plan view that illustrates the leveling frame and lint withdrawal hoods of the cleaning apparatus.

FIG. 6 is a side elevation of the leveling frame and lint withdrawal hoods.

FIG. 7 is a schematic view that illustrates the central collector unit and common duct of the improved travelling suction cleaning apparatus.

DESCRIPTION OF THE PREFERRED EMBODIMENT

Figure 1:
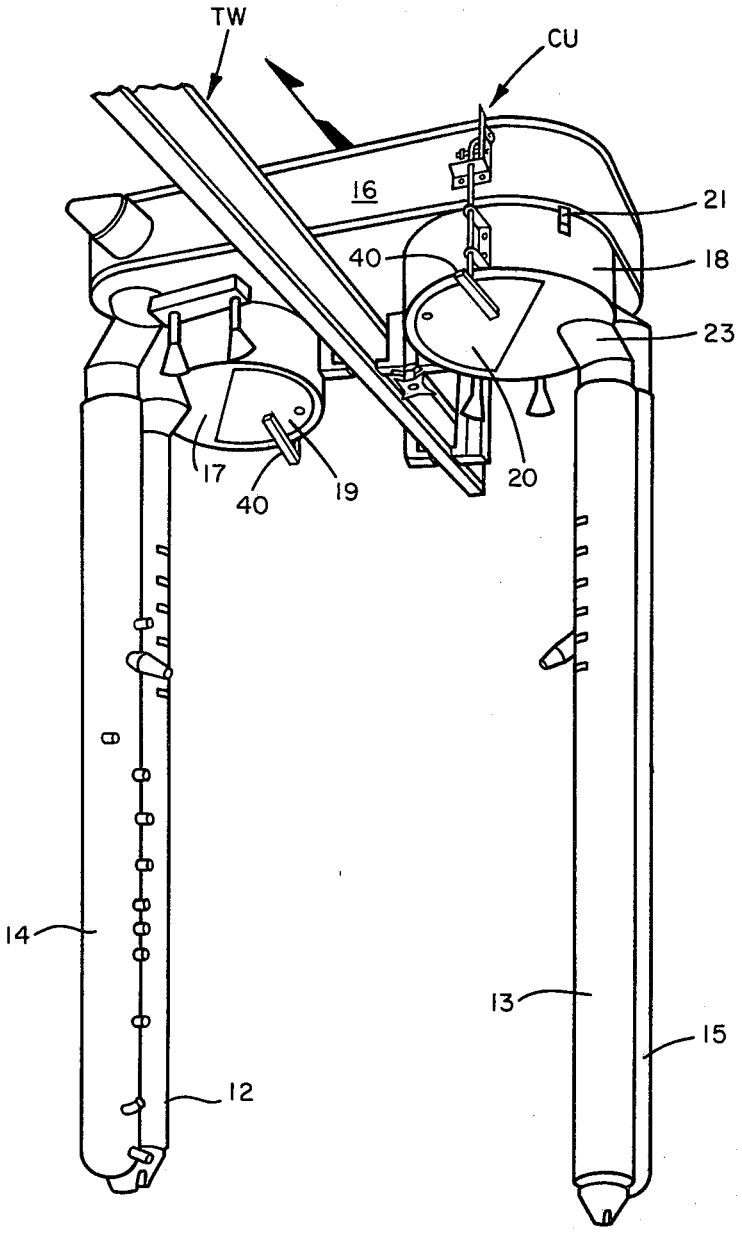
FIG. 1 is an isometric view illustrating a travelling cleaner unit of the present invention as supported on the trackway.

Referring now more particularly to FIG. 1, the travelling cleaning apparatus of the present invention includes several cleaner units CU which are driven on separate endless trackways TW. Only a single trackway and cleaner unit are shown herein, the others being of essentially the same construction. The cleaner unit CU is driven along the trackway longitudinally of a textile machine such as a spinning frame. The cleaner unit is designed to keep the spinning frame and adjacent floor area reasonably free from lint accumulations. The cleaner unit CU is propelled along the trackway TW by a motorized tractor TR which is schematically shown in FIG. 7. The basic features of the cleaner unit and tractor are described in the aforementioned, commonly owned U.S. Pat. No. 3,245,103 to J. F. King, and the disclosure of the King patent is incorporated herein by reference. It is also noted that the cleaner unit is similar to the cleaner unit disclosed in the aforementioned Catalog 40-A.

In accordance with the present improvement, leveling frames LF (FIGS. 5–8) are provided at lint collection stations LCS respectively located along the trackways TW. As shall be described hereinafter in detail, each leveling frame includes transversely spaced lint removal hoods HD1 and HD2 which are connected to a common duct DUC. The common duct is connected to a central collector unit CCU that includes a suction fan FN. As a cleaner unit CU arrives at a lint removal hood, the lint collection chambers of the cleaner unit are opened and exposed to a partial vacuum induced by the hoods so that the lint is removed from the cleaner unit while the cleaner unit is moving along the trackway. The lint removed from the several cleaner units is all stored in the central cleaner unit. Such central storage of course reduces the waste disposal problems associated with the entire textile room cleaning apparatus.

Figure 8:
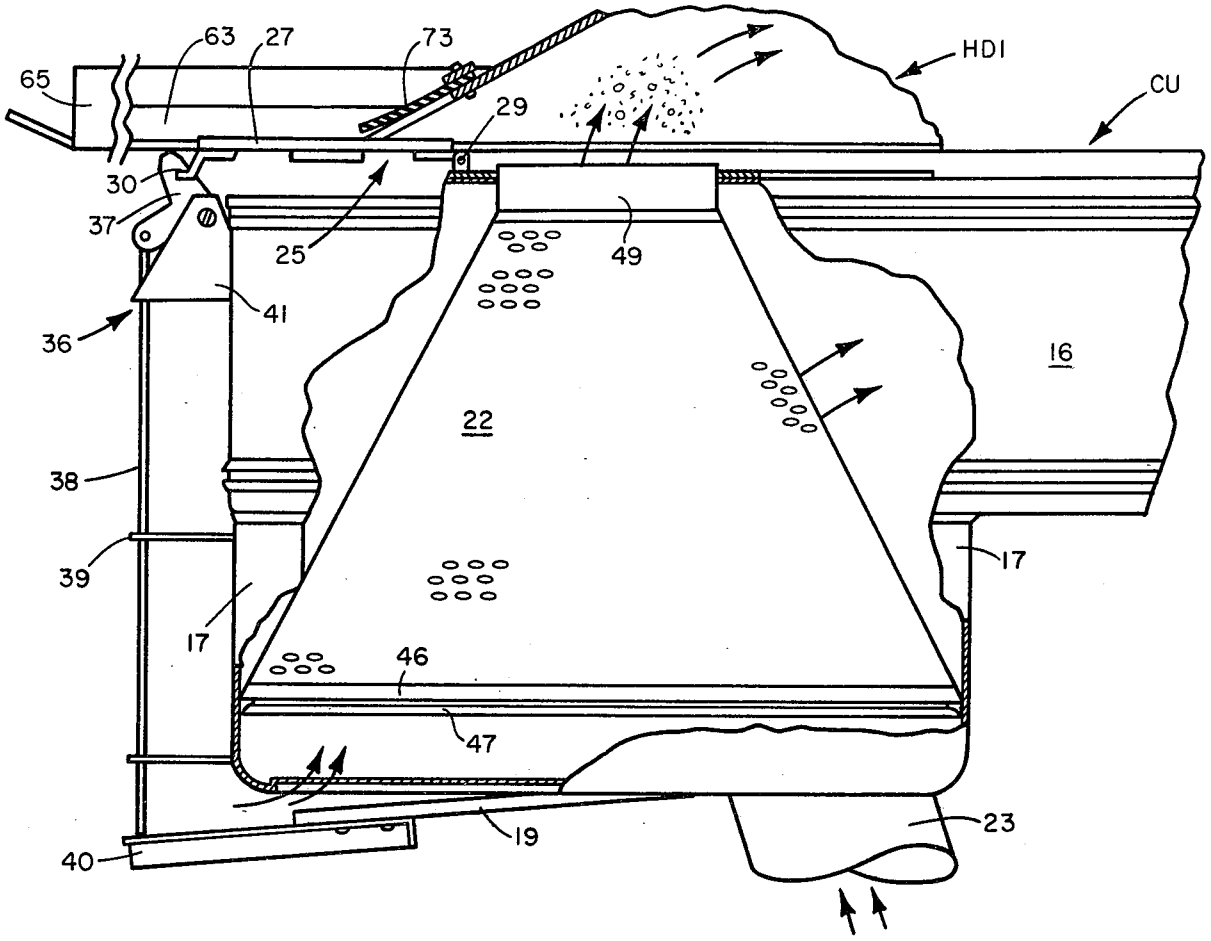
FIG. 8 is a fragmentary side elevational view that is broken away to illustrate one of the conical screens in the travelling cleaner unit, wherein the cleaner unit is moving under the lint removal hood and the doors above and below the screen are being held open.

Referring again to FIG. 1, the cleaner unit CU includes a right suction trunk 12, a left suction trunk 13, a right blower trunk 14 and a left blower trunk 15. The terms, right and left, are used herein with reference to the direction of travel of the cleaner unit and as would be seen by one looking at the trailing or rear end of the cleaner unit. The trunks 12–15 depend from a cleaner housing 16 that extends transversly above the trackway TW. The right blower trunk is arranged across from the left suction trunk and the left blower trunk is arranged across from the right suction trunk. This arrangement is described in the King U.S. Pat. No. 3,245,103. The suction trunks 12 and 13 are respectively connected to the bottom ends of right and left canisters 17 and 18. The canisters are removeably attached by latches 21 to the underside of the housing 16. Referring to FIG. 8, a frustoconical screen 22 is contained within each canister; the screen is supported uprightly in the respective canister with its smaller end upwardly disposed. The screen strips lint that is carried in the air drawn into the suction trunks. As shown in FIG. 1, the intake opening 23 for the respective suction trunk is formed in the bottom of the respectve canister to direct the lint-laden air into the relatively large diameter lower end of the associated lint-stripping screen 22.

The cleaner unit CU includes a centrally located blower (not illustrated) that is located below the blower cover plate 24 shown in FIG. 4. As depicted by arrows in FIG. 8, the lint-laden air is drawn into the interior of the conical screen 22 and the cleaned air is circulated by the blower toward the center of the housing. The cleaned air is redirected by the blower from the center of the housing into the intakes to the blower trunks 14 and 15. The screens 22 thus define the lint collection chambers of the cleaner unit.

In the past, the lint accumulated within the screens in the canisters 17 and 18 was removed manually by opening access doors 19 and 20 in the bottoms canisters 17 and 18, respectively. The cleaner unit of the present invention includes the access doors 19 and 20 formed in the right and left canisters 17 and 18, respectively. Such doors are spring-biased into closed positions to seal the lower ends of the canisters. The access doors provide easy access to the interiors of the canisters to enable inspection and any manual cleaning the screens as may be felt necessary at such time. It is contemplated that such manual cleaning would only be done on an infrequent basis as a part of a periodic maintenance program because the lint within the canisters is, as made manifest herein, automatically extracted at the lint collection station LCS.

Figure 4:
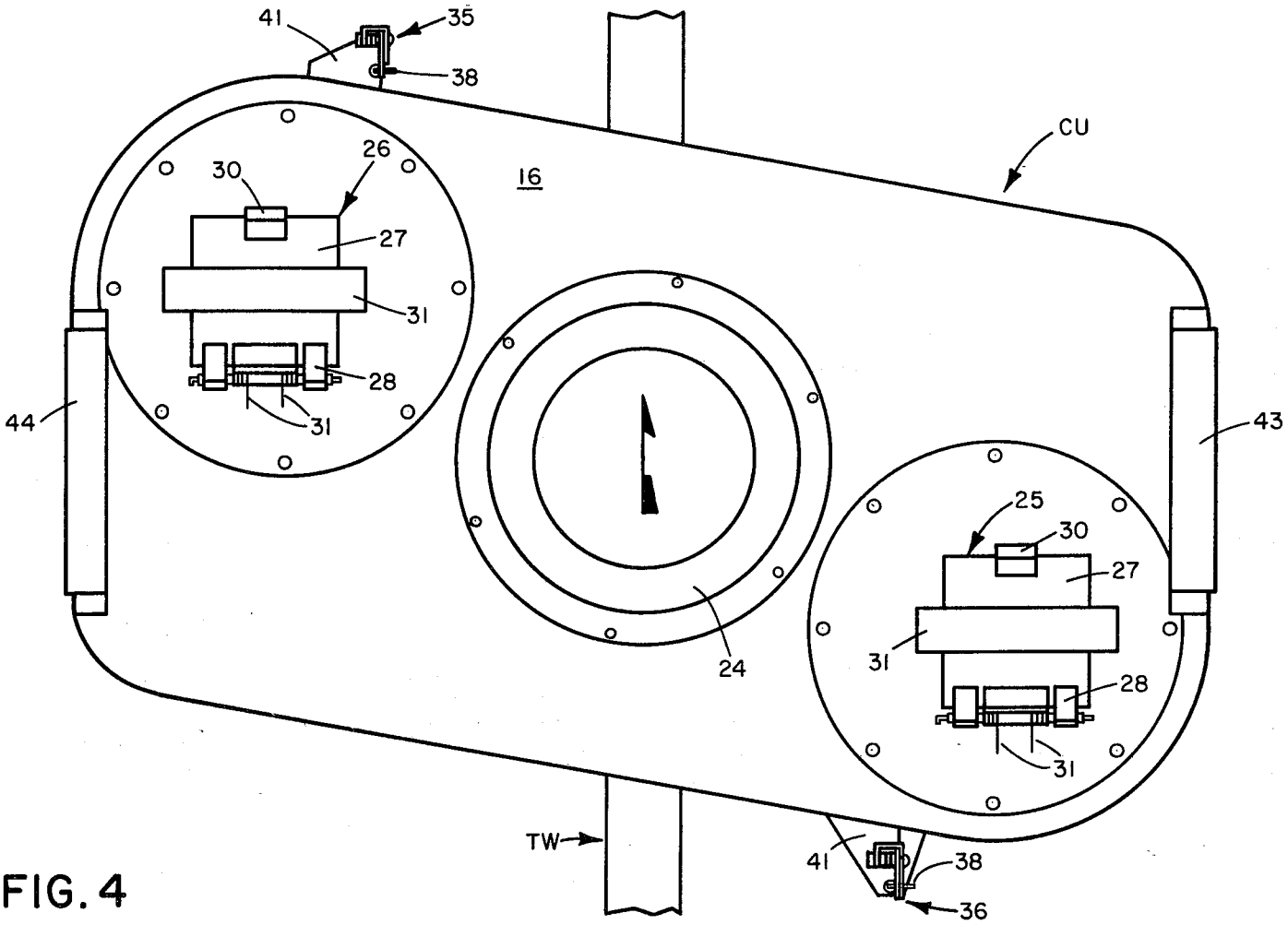
FIG. 4 is a top plan view of the travelling cleaner unit.

Now referring to FIGS. 4–6 and 8, the cleaner unit CU is provided with lint removal doors 25 and 27 situated directly over the screens 22 supported within the right and left canisters 17 and 18, respectively. Such doors 25 and 26 are of identical construction, and so the construction of the right door 25 only will be described. Door 25 includes a rectangular lid that has downwardly extending flanges at its edges. A sheet of soft rubber is contained within the lid to normally form an air-tight seal with the upper end of the associated lint-stripping screen 22. The lid is pivotably attached by a hinge 28 to the top wall of the cleaner unit housing 16 so that the lid thus rotates about a hinge pin 29. The hinge is so connected to the cleaner housing that the hinge pin 29 extends transversely of the direction of travel of the cleaner unit. The lids are hinged to the housing proximal the trailing ends of the discharge openings formed by the upper ends of the screens so that the lids may be pivoted counter to the direction of travel of the cleaner unit. The doors are biased into the closed positions by springs 31 (FIG. 4). The lint removal doors 25 and 26 each have a Z-shaped latch or hook 30 that is attached to the leading end of the lid 27. Also, each of the lint-removal doors has a flat, rigid strip or bar 31 extending transversely of the direction of travel of the cleaner unit CU.

Figure 2:
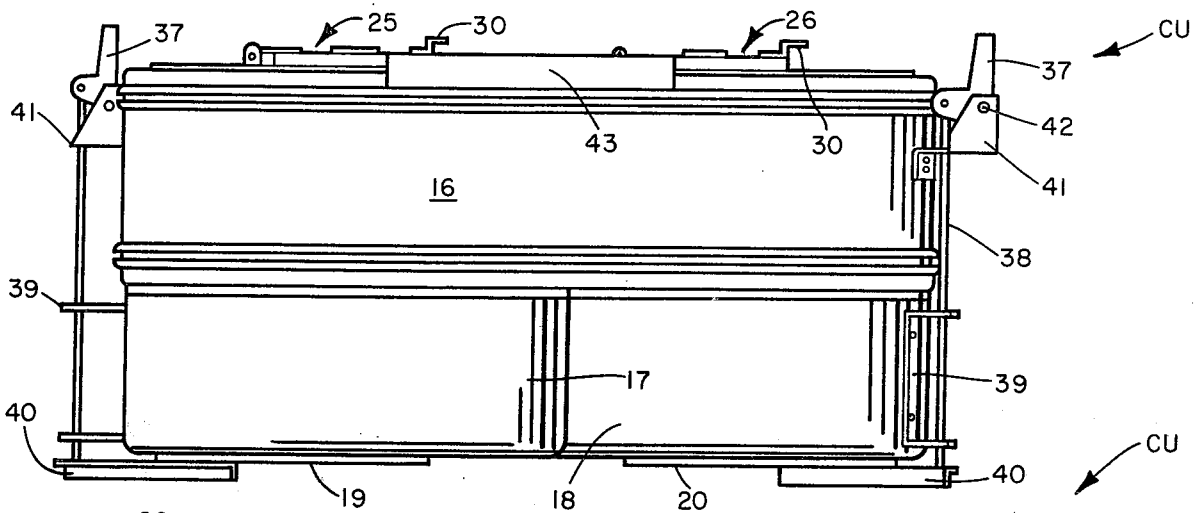
FIG. 2 is an enlarged side elevational view of the upper housing portion of the travelling cleaner unit with the suction and blower tubes thereof being removed for the sake of clarity.
Figure 3:
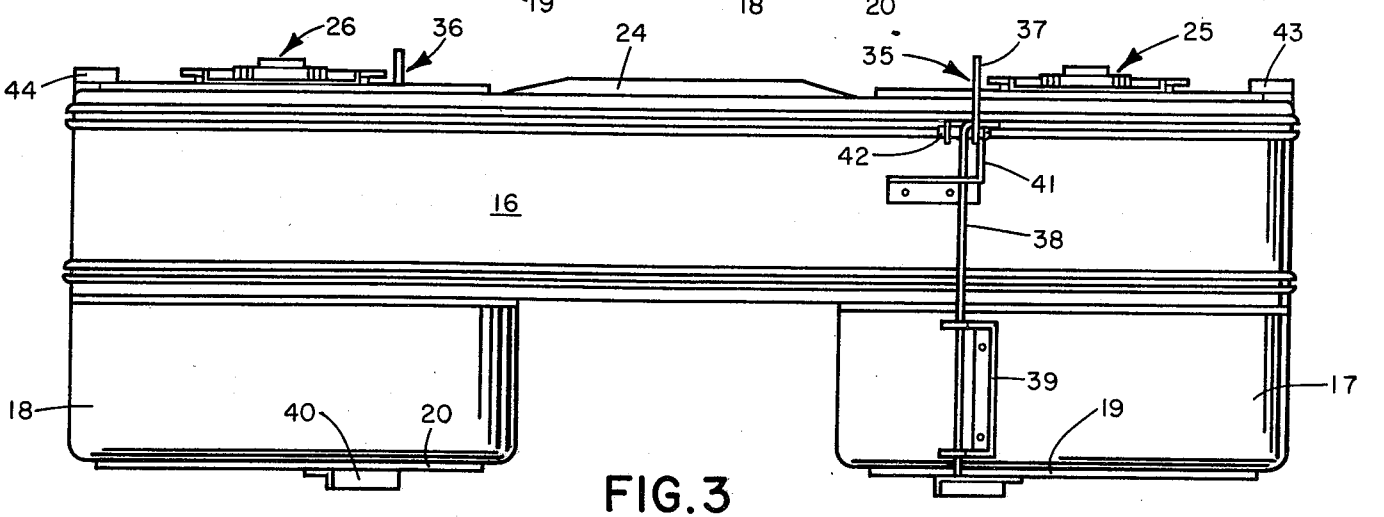
FIG. 3 is an elevational view of the trailing end of the travelling cleaner unit.

The cleaner unit CU further includes means enabling the bottom access doors 19 and 20 to be opened at the lint collection station LCS. Such means comprises two bellcrank operated, pushrod mechanisms 35 associated with the right access door 19 and a similar mechanism 36 for the left access door 20. Referring to FIG. 2, each access door opening mechanism includes a bellcrank 37, a pushrod 38, a pushrod guide bracket 39 and an angle iron 40 that is attached to the right access door 19. The bellcrank 37 is mounted to the trailing or rear side wall of the cleaner housing 16 by a bracket 41, with the bellcrank being pivoted on a 42 pin. The bellcrank is pivotably mounted to the housing to pivot about an axis that is, again, transverse to the direction of travel of the cleaner unit. One arm of each bellcrank extends a selected distance above the cleaner unit housing 16, and the pushrod 38 is connected to the other arm of each bellcrank. The pushrod is received in oversized holes in the respective guide bracket 39 (FIG. 3) which is mounted to the side wall of the right canister 17 to vertically guide the pushrod. The free lower ends of the pushrods bear against the outwardly projecting ends of the respective angle irons 40. As shall be explained later, the upstanding arms of the bellcranks are depressed by cam rails at the lint removal station LCS to thus lower the pushrods and open the access doors 19 and 20 by limited amounts.

As is best illustrated in FIG. 4, flat skid members 43 and 44 are mounted to the right and left sides of the top wall of the blower housing 16. Such skid members ride against the leveling frame LF at the lint collection station LCS, as also is described later.

The mounting of the screen 22 within the associated canister 17 or 18 will now be described with reference to FIG. 8. The conical screen 22 is substantially tapered. For example, it may have a diameter of about 19.5 in. at its lower end and of about 6 in. at its upper end and have a height of about 13 in. Each screen has a imperforate ring 46 affixed at its lower end that is supported on a circular flange 47 mounted within the canister above the bottom wall thereof. A cylindrical collar 49 is affixed to the small diameter upper end of each screen. The collar 49 projects upwardly through a discharge opening formed in the top wall of the cleaner unit housing 16. The rubber pads within the lids of the lint removal doors 25 and 26 normally form substantially air-tight seals with the circular upper edges of the collars 49 of the respective screens.

The leveling frame LF includes a steel framework which is shown in FIGS. 5 and 6. The framework is rigidly suspended by supports from the ceiling of the textile room at the lint collection station LCS at a selected height above the trackway TW. The frame includes skid rails 51 and 52 extending longitudinally thereof parallel to the trackway TW and centered over the trackway. The skid rails 51 and 52 are spaced apart so that they bear against the skid members 43 and 44 affixed to the top wall of the cleaner unit CU. The frame LF is horizontally mounted to the room ceiling to level the cleaner unit CU as it moves thereunder. The leveling frame stabilzes the cleaner unit when the access doors 19 and 20 and the lint removal doors 25 and 26 are opened.

When the cleaner unit CU arrives at the lint collection station LCS, the latches 30 of the lint removal doors 25 and 26 are engaged by lifting mechanisms 54 and 55, respectively. The two lifting mechanisms are identical and are suspended from longitudinally spaced cross-members of leveling frame LF. The latching mechanisms 54 and 55 are mounted to the leveling frame to simultaneously engage and pivot open the associated lint removal doors 25 and 26, respectively. Each of the lifting mechanisms 54 and 55 includes a vertically depending latch bar 57 that has a forwardly projecting flange 58 at its lower end. The flanged latch bar is held at a height such that its lower end engages the forwardly projecting, upper portion of the Z-shaped hook 30 of the respective lint removal door. Each latch bar 57 is pivotably mounted to a support bar 59 for pivoting about an axis that is transverse of the direction of travel of the cleaner unit. Bars 59 are pivotably attached to the leveling frame and are supported at their outer ends (which extend counter to the cleaner units direction of travel) by eye-bolts 60 which permit the height of the latch bars 57 to be precisely adjusted. The cleaner unit CU is first leveled by the leveling frame LF skid rails 51 and 52; and as it proceeds forwardly, the latch bars engage simultaneously the hooks 30 of the associated lint removal doors. As the doors are swung open, latch bars 57 of course pivot in the direction of travel of the cleaner unit.

With continued forward travel of the cleaner unit CU, the end portions of transversely projecting slide strip 31 of the associated partially opened lint removal door 25, 26 become engaged against the upstream ends pair of longitudinally extending, transversely spaced, horizontal cam rails 62 and 63. The cam rails are transversely spaced to engage the undersides of the end of the door strips to first cam the door downwardly counter to the direction of travel; and once the door is swung completely open as shown in FIG. 8, the cam rails hold the spring-biased doors open as they are carried under the respective hoods to hold the lint removal door completely open as the associated canister is carried under the lint removal hood HD1, HD2. It is noted that the cam rails 62 and 63 also support the respective hood HD1, HD2. As soon as the door strips 31 clear the downstream ends of the rails 62, 63, the doors swing back into their normally closed, positions against the screens. The cam rails are suspended from the leveling by rails (not shown) that depend from the cross-members of the frame (FIG. 5).

The bellcrank mechanisms 35 and 36 are engaged by cam or striker members 65 and 66 substantially at the same time the lifting mechanisms 54 and 55 engage the right and left lint-removal doors 25 and 26. The striker members, as shown in FIGS. 5 and 8, are straight rails that have upwardly slanted front and rear ends. The striker members are mounted to the underside of the leveling frame LF parallel to the direction of travel of the cleaner unit CU and at locations that are aligned with the associated bell crank 37 of the bellcrank mechanism. Such striker members are mounted to downwardly cam the bellcranks to simultaneously open the access doors 19 and 20 and to hold the access doors open while the screens are below the removal hoods HD1 and HD2, and to cause such doors to simultaneously close under their own spring mountings after the lint has been removed from the associated canister screen.

The hoods HD1 and HD2 are of identical construction, but are mounted in a reversed relationship so that the connector portions 70 and 71 at their upper ends are located nearer the center of the leveling frame (FIGS. 5 and 6). Such mounting arrangement is convenient, as it minimizes the overall length of the leveling frame while yet permiting the frame to be rigidly attached at its ends to the ceiling by the aforementioned supports. The hoods are elongated in the direction of travel of the cleaning unit. A leather flap 73 is mounted in a notch formed at the leading or upstream end of each hood 70, and a similar leather flap 74 is mounted in a notch formed in the downstream edge of the hood 70. The elongate configuration of the mouth of the hood 70 and 71 enables a partial vacuum to be applied for a longer time to the opened lint collection chambers formed within the interior of the screens 22 within the canisters 17 and 18. A substantial amount of the lint accumulated within this respective screen is removed during such transit time which has been found to be only a matter of a couple of seconds.

Given the exemplary dimensions of the hood as just set forth, when the cleaner unit is driven on the trackway TW at approximately 85 feet per minute, which is a typical speed, the relatively small discharge openings to the respective screens 22 are exposed to partial vacuum within the hood for a period of only about 1 second. Due to the vigorous upward gust of air that is created with the conical screens at the lint collection station, substantially all of the accumulated masses of lint within the screens is discharged into the hoods.

FIG. 7 schematically illustrates the central collector CCU and common duct DUC for applying suction to the hoods, HD1 and HD2. It will be seen that a valve 77A is connected between the common duct and the hoods at the lint collection station LCS. The valve 77A may be a bladder valve that is operated by separate pneumatic control valves (not shown). The pneumatic valves are controlled by a double-acting electric solenoid valve (also not shown). A limit switch (not shown) is mounted to the trackway TW at a position upstream from and adjacent the lint collection station LCS to be engaged by the tractor and cleaner unit. The limit switch actuates the aforementioned solenoid valve which controls the valve 77A. Valve 77A is normally closed and is opened upon actuation of the limit switch. As may be noted from FIG. 7, other valves 77B and 77C are connected in the connector ducts that lead to the pairs of lint removal hoods situated at the other lint collection stations within the textile room.

From the foregoing, it will be appreciated that the travelling cleaner apparatus of the present invention is adapted to rapidly evacuate the lint from within both conical screens 22 while the cleaner unit CU is traveling at its normal speed through the lint collection station LCS. At the lint collecting station, the blower therein continues to operate to circulate air through the associated suction trunks 12 and 13 into the associated screens 22 and then outwardly through the blower tubes 14 and 15. This air flow serves to support the accumulated masses of lint within the conical screens 22 (FIG. 8) and urge the masses of lint upwardly toward the narrow discharge end of the screens. When brought under the hoods HD1 and HD2, the accumulated lint is sucked quickly from the upper end of the screen. As shown by the arrows in FIG. 8, air flows through the opening formed between the lower access door 19, 20 and the cleaner housing 16 and then upwardly into the lower end of the screen. A vigorous air circulation pattern is induced immediately when the opened discharge ends of the screens come under the hoods, which air flow causes the accumulated lint to be abruptly ejected directly through the discharge openings formed in the screen collars 49 into the lint collection hood HD1, HD2.

Preferably, a thin mat of accumulated lint, e.g. 1/16 in. thick, is left within the associated canister 17, 18 against the inner surfaces of the screens 22. Such thin mats of lint enhance the filtration effectiveness of the screens to strip further contaminants from the room air than would be obtained by the perforate screen surfaces alone. The conical screen configuration and discharge circulation pattern is such that such relatively thin layer of lint is normally retained in each screen after the cleaning unit CU traverses the lint collection station LCS and the access doors and lint removal doors are shut.

The travelling cleaner unit CU and leveling frame LF may be operated as just described together with a straight trackway—as opposed to an endless trackway in the form of a loop— without making structural changes to the automatic lint removal arrangement. When a straight trackway is used, the drive motor of tractor TR is reversed at the ends of the trackway to thereby cause the cleaner unit to move back and forth over the underlying row of textile machines. When moving in the direction opposite that shown in the drawings, the latch bars 57 of the lifting mechanisms 54 and 55 will simply swing out of the way of the cover latches 30. The cover latches 30 will, when moved in such opposite direction, plow through the resilient flaps 73 and 74 (FIGS. 5 and 8) mounted in the notches in the ends of the lint removal hoods HD1 and HD2. Also when being driven in such opposite direction, the bellcrank mechanisms 35 and 36 for the access doors will be actuated in the opposite direction by the cam rails 65 and 66. Thus, the pushrods 38 will be momentarily raised by means of the cam rails; the access doors will accordingly remain closed. It is noted that the bellcranks 37 are biased by torsion springs received on pins 42 to return the bellcranks to the upright positions illustrated in FIGS. 2 and 3. Thus, it will be understood that the present mechanically operated lint removal arrangement is readily adaptable to any trackway configuration.

Although the best mode contemplated for carrying out the present invention has been shown and described, it will be apparent that modifications and variations may be made without departing from what is regarded to be the subject matter of the invention.

We claim:

1. An improved travelling suction apparatus for cleaning lint from machines including a horizontal trackway mounted over the machines to be cleaned, and a cleaner unit that is moved along the trackway, the cleaner unit including a housing, a pair of suction tubes that respectively depend from the housing at opposite sides of the trackway, means within the housing for drawing lint-laden air upwardly through the tubes and into the housing, lint collection chambers at opposite sides of the housing that respectively receive lint-laden air from said tubes, and a screen within each chamber for filtering lint from the air to cause the lint to accumulate within the respective chambers, wherein the improvement comprises: means for automatically removing the lint accumulated in the trackway comprising, each screen being annular and open at both ends, conduit means interconnecting the interiors of the ends of the screens with the respective suction tubes, covers respectively mounted to the housing adjacent the opposite ends of the annular screens, means for movably connecting the covers to the cleaner housing to normally hold the covers in closed positions and to permit the covers to be opened to permit lint to be extracted from said opposite ends of the screens, means located at a lint removal station along the trackway for opening said covers, and hood means stationarily mounted at said lint removal station for applying suction to remove substantially all of the lint from within the screens while said covers are open.

2. The improved travelling suction apparatus according to claim 1 wherein said housing includes doors respectively situated adjacent the ends of the screens which communicate with the suction tubes, means for normally holding the doors in closed positions and for permitting the doors to be opened, and means located at said lint removal station for opening said doors and for holding the doors open while the cleaner unit is moving below said hood means.

3. The improved travelling suction apparatus according to claim 1 wherein said means for movably connecting the covers to the housing comprise hinges that permit the covers to pivot about axes that are perpendicular to the trackway, said covers having latches projecting upwardly therefrom, and wherein said cover opening means comprises means engageable with said cover latches for simultaneously pivoting the covers about the respective hinge axes counter to the direction of travel of the cleaner unit.

4. The improved lint cleaning apparatus according to claim 3 wherein each of said covers is biased by a spring into a closed position over the screen, and said cover opening means further includes a slide bar attached to each cover and means extending at a selected height relative to the trackway for camming the slide bars downwardly to hold the respective covers open until after moving out from under said hood means.

5. An improved apparatus for cleaning lint from textile machines including a horizontal trackway mounted over the machines to be cleaned, and a cleaner unit propelled along the trackway, the cleaner unit including a housing, a pair of suction tubes depending from the housing on opposite sides of the trackway, means mounted to the housing for drawing air upwardly through the suction tubes into the housing, and separate screens on opposite sides of the trackway for respectively stripping lint from the lint-laden air delivered by the depending suction tubes, wherein the improvement comprises: each of said screens being frustoconical and having open small and large ends, means for mounting the screens within the housing so that the lint-laden air delivered by the respective suction tubes ingresses through the large open ends thereof, lint removal doors hingedly mounted to the housing to normally block air through the small ends of the screens so that the incoming air flows laterally through the screens, means at a lint removal station along the trackway for opening said lint removal doors, and hood means at said lint-removal station for applying suction to extract the accumulated lint from within the screens through the small ends thereof.

6. The improved apparatus according to claim 5 further comprising an access door movably mounted to the housing adjacent the large end of each screen, and means for opening said last-mentioned doors when the cleaner unit moves through the lint removal station.

7. The improved apparatus according to claim 5 wherein said means for opening the lint removal doors comprises a frame stationarily mounted at said lint removal station over the trackway for stabilizing the cleaner unit on the trackway as it is propelled thereunder, the lint-removal doors having latches attached thereto, means depending from and pivotally connected to said frame for engaging the latches and pulling the doors open in a rotative direction that is generally counter to the direction of travel of the cleaner unit.

8. An improved apparatus for cleaning lint from textile machines including a horizontal trackway mounted over the machines to be cleaned, and a cleaner unit propelled along the trackway, the cleaner unit including a housing, a pair of suction tubes respectively depending from the housing on opposite sides of the trackway, means mounted to the housing for drawing air upwardly through the suction tubes and into the housing, and separate screens on opposite sides of the trackway for stripping lint from the air delivered by the respective depending suction tubes, wherein the improvement comprises: each screen including an annular screen portion and being open at both ends, each suction tube communicating with one end of the associated screen, lint removal doors movably mounted to the housing to normally block air flow from those ends of each screen that are opposite the ends communicating with the suction tubes to thus cause air to flow laterally through the screens, means at a lint collection station for momentarily opening the doors to allow the lint accumulated in screens to egress through said opposite ends, and stationary hood means at said lint removal station for applying suction in the vicinity of the opened doors to extract lint from said opposite ends of the screens.

9. The improved apparatus according to claim 8 wherein said screens have an imperforate tubular portion extending from the ends thereof that are adjacent the associated lint removal doors, and said lint removal doors being normally engaged in an air-tight seal directly against the tubular portion, whereby when said suction is applied at the lint removal station, the accumulated lint is sucked directly into said hood means.

10. The improved apparatus according to claim 8 wherein lint removal doors are connected by hinges to the housing to pivot about axes transverse of their direction of travel and in a rotative direction generally counter to a preselected direction of travel, and said door opening means includes a frame mounted above the trackway for stabilizing the cleaner unit as it is propelled through the lint removal station, said doors having latches and means depending from said frame for engaging the latches when the cleaner unit is moving in said preselected direction of travel.

11. The improved apparatus according to claim 8 further comprising further doors mounted to the housing adjacent the open ends of the screens which communicate with the suction tubes, and means at said lint removal station for opening said further doors to thereby augment the air circulation patterns through the screens in the direction of the hood means.

12. An improved travelling suction apparatus for cleaning lint from textile machines including a horizontal trackway mounted overhead the machines to be cleaned, and a cleaner unit that is propelled along the trackway, the cleaner unit including a housing extending transversely of the trackway and centered thereover, a pair of canisters respectively mounted under said housing at opposite sides of the trackway, suction tubes respectively depending from and communicating with said canisters for applying suction at opposite sides of the machines to be cleaned, a screen mounted within each canister, means mounted to said housing at the center thereof for drawing lint-laden air upwardly through said suction tubes and thereafter through said screens to cause lint to accumulate in said screens, wherein the improvement comprises: means for automatically removing the accumulated lint from within said screens while the cleaner is moving along the trackway comprising, each screen being annular and open at both ends, each screen being mounted uprightly in each canister, each suction tube communicating with the interior of the lower end of the associated screen, a lint removal door mounted over each screen, means for movably connecting each lint removal door to the cleaner housing to normally hold the cover in a closed position so that air drawn into the lower end of the screen egresses laterally through the screen, means located at a lint removal station along the trackway for opening said lint removal doors to permit lint to be extracted from the open upper ends of the screens, and hood means stationarily mounted at said lint removal station for applying suction to remove substantially all the lint accumulated within said screens.

13. The improved travelling suction cleaning apparatus according to claim 12 wherein said housing further includes an access door situated below each screen, means for normally holding said access doors in closed positions, and means located at said lint removal station for opening said access doors and for holding the doors open while the cleaner unit is moving through said lint removal station.

14. The travelling suction apparatus according to claim 12 wherein said means for movably connecting said lint-removal doors to the housing comprise: hinges for permitting the lint-removal doors to pivot about axes transverse of their direction of travel and in a rotative direction generally counter to a preselected direction of travel of the cleaner unit, and said lint-removal door opening means includes a frame mounted above the trackway for stabilizing a cleaner unit as it is propelled through a lint-removal station, said lint-removal doors having hooks projecting upwardly therefrom, and means depending from said frame for engaging said hooks when the cleaner unit is moving in said preselected direction of travel.

15. The improved lint cleaning apparatus according to claim 14 wherein each of the lint removal doors is biased on its hinge by a spring into said closed position over the associated screen, and said lint-removal door opening means further includes a slide bar attached to each door and means attached to said frame and extending parallel to the direction of travel of the cleaner unit for camming the slide bars downwardly to hold the lint removal doors open until after moving out from under said hood means.

* * * * *